US009392855B2

(12) United States Patent
Taylor

(10) Patent No.: US 9,392,855 B2
(45) Date of Patent: Jul. 19, 2016

(54) BACKPACK WITH INTEGRATED RIGID STORAGE CONTAINER

(71) Applicant: Thule Organization Solutions, Inc., Niwot, CO (US)

(72) Inventor: Rebecca Taylor, Longmont, CO (US)

(73) Assignee: Thule Organization Solutions, Inc., Niwot, CO (US)

( * ) Notice: Subject to any disclaimer, the term of this patent is extended or adjusted under 35 U.S.C. 154(b) by 0 days.

(21) Appl. No.: 14/444,776

(22) Filed: Jul. 28, 2014

(65) Prior Publication Data

US 2015/0027833 A1 Jan. 29, 2015

Related U.S. Application Data

(63) Continuation-in-part of application No. 12/956,347, filed on Nov. 30, 2010, now Pat. No. 8,800,737.

(60) Provisional application No. 61/858,984, filed on Jul. 26, 2013, provisional application No. 61/265,212, filed on Nov. 30, 2009.

(51) Int. Cl.

| | |
|---|---|
| ***A45C 3/02*** | (2006.01) |
| ***A45C 13/36*** | (2006.01) |
| ***A45C 3/00*** | (2006.01) |
| ***A45C 13/02*** | (2006.01) |
| ***A45C 13/00*** | (2006.01) |
| ***A45F 3/04*** | (2006.01) |

(52) U.S. Cl.

CPC . *A45C 13/36* (2013.01); *A45C 3/00* (2013.01); *A45C 13/008* (2013.01); *A45C 13/02* (2013.01); *A45F 3/04* (2013.01); *A45C 2003/008* (2013.01)

(58) Field of Classification Search

CPC ..... A45C 2003/008; A45C 13/02
USPC ..... 206/315.5; 190/111, 112; 220/849
See application file for complete search history.

(56) References Cited

U.S. PATENT DOCUMENTS

| | | | | | |
|---|---|---|---|---|---|
| 1,793,899 | A | * | 2/1931 | Benforado | A45C 3/06 150/106 |
| 1,861,948 | A | | 6/1932 | Barkdoll | |
| 1,900,508 | A | * | 3/1933 | Lewis | A45C 3/00 150/106 |
| 1,927,624 | A | * | 9/1933 | Appel | A45C 3/06 150/106 |
| 2,213,821 | A | * | 9/1940 | McCurdy | A45C 5/00 190/111 |
| 2,988,125 | A | * | 6/1961 | Reynolds | A45C 11/38 150/116 |
| 3,147,788 | A | * | 9/1964 | Pinnola | A45C 15/00 131/235.1 |
| 4,119,181 | A | | 10/1978 | Jones | |
| 4,236,615 | A | | 12/1980 | Ginat | |

(Continued)

FOREIGN PATENT DOCUMENTS

FR 595746 10/1925

OTHER PUBLICATIONS

Extended European Search Report for European Patent Application No. 10192913.1, dated Apr. 14, 2011 7 pages.

(Continued)

*Primary Examiner* — Sue A Weaver
(74) *Attorney, Agent, or Firm* — Sheridan Ross P.C.

(57) ABSTRACT

A luggage device with a first enclosure and at least one additional enclosure which includes a protective compartment is provided. The protective compartment may be adapted for isolated and secure storing of delicate or fragile items, and is preferably separate and distinct from the first enclosure and a primary storage volume.

17 Claims, 12 Drawing Sheets

(56) References Cited

U.S. PATENT DOCUMENTS

| | | | | |
|---|---|---|---|---|
| 4,319,616 | A * | 3/1982 | Light | A63B 55/00 206/315.2 |
| 4,383,563 | A * | 5/1983 | Kirchhoff, Jr. | A63B 55/00 190/18 A |
| 4,629,040 | A | 12/1986 | Jones | |
| 4,767,039 | A | 8/1988 | Jacober | |
| 4,846,346 | A | 7/1989 | Kime | |
| 5,197,580 | A | 3/1993 | Berman et al. | |
| 5,265,719 | A | 11/1993 | Wand | |
| 5,267,679 | A | 12/1993 | Kamaya et al. | |
| 5,310,031 | A * | 5/1994 | Plath | A45C 5/14 190/111 |
| 6,213,268 | B1 | 4/2001 | Dancyger | |
| 6,446,688 | B1 | 9/2002 | Sutton | |
| 6,481,239 | B2 * | 11/2002 | Hodosh | A45C 11/20 220/592.17 |
| 6,523,653 | B2 | 2/2003 | Roegner | |
| 6,612,472 | B1 | 9/2003 | Zakarin | |
| 6,863,201 | B2 | 3/2005 | Esqueda | |
| 7,222,733 | B2 * | 5/2007 | Kim | A63B 55/00 206/315.3 |
| 8,474,613 | B2 | 7/2013 | Murdoch et al. | |
| 8,800,737 | B2 | 8/2014 | Fair et al. | |
| 2002/0108828 | A1 * | 8/2002 | Soskin | A45C 1/024 190/112 |
| 2003/0024960 | A1 | 2/2003 | Greenstein et al. | |
| 2003/0136623 | A1 | 7/2003 | Renz et al. | |
| 2005/0098598 | A1 | 5/2005 | Kuhn | |
| 2005/0236290 | A1 * | 10/2005 | Ohi | A01K 97/06 206/373 |
| 2006/0006036 | A1 | 1/2006 | Godshaw et al. | |
| 2006/0113203 | A1 | 6/2006 | Daley | |
| 2007/0214613 | A1 * | 9/2007 | Shiao | A63B 55/00 24/303 |
| 2008/0164265 | A1 | 7/2008 | Conforti | |
| 2010/0276436 | A1 | 11/2010 | Liu et al. | |
| 2013/0206527 | A1 * | 8/2013 | Von Furstenberg | A45C 3/02 190/111 |
| 2013/0292220 | A1 * | 11/2013 | Kerley | A45C 5/03 190/108 |

OTHER PUBLICATIONS

Official Action for China Patent Application No. 201020658276.6, dated May 12, 2011 2 pages.

Notification of Grant of Patent Right for China Patent Application No. 201020658276.6, dated Aug. 17, 2011 2 pages.

International Search Report and Written Opinion for International (PCT) Application No. PCT/US2014/048371, mailed Nov. 17, 2014, 12 pages.

* cited by examiner

BACKPACK WITH INTEGRATED RIGID STORAGE CONTAINER

This U.S. Non-Provisional Patent Application claims priority from U.S. Provisional Patent Application Ser. No. 61/858,984, filed Jul. 26, 2013, the entire disclosure of which is hereby incorporated by reference in its entirety. This application is a Continuation-in-Part of U.S. patent application Ser. No. 12/956,347, filed Nov. 20, 2010, now U.S. Pat. No. 8,800,737 issued Aug. 12, 2014, which claims priority to U.S. Provisional Patent Application 61/265,212, filed Nov. 30, 2009, the entire disclosures of which are incorporated by reference herein.

FIELD OF THE INVENTION

Embodiments of the present invention generally relate to storage cases having one or more storage compartments. More specifically, one embodiment of the present invention is a backpack having an easily-accessible rigid storage container that protects fragile items.

BACKGROUND

It is currently known in the art to provide a substantially rigid compartment or shell as a luggage device to protect contents to be stored or carried. There exists a long felt need, however, to provide a luggage unit that offers the convenience of a lightweight and collapsible soft luggage bag while still providing optional protection for smaller items such as glasses, ski goggles, electronic devices, and the like. For example, when soft shell luggage is desired for travel and transportation where the luggage may be subjected to impact or compression, a relatively small portion of the luggage that provides protection from impact and/or compression forces is desirable. Additionally, protection from impact and compression from objects co-housed within the luggage is often desirable.

U.S. Pat. No. 4,629,040 to Jones discloses a rigid insert provided in a soft luggage shell that is removably held in place by a twistable retainer ring and is hereby incorporated by reference in its entirety. However, Jones fails to teach a device wherein the rigid insert occupies only a portion of the soft luggage shell that isolates certain items in a rigid surrounding and thereby protects the items from impact from other items in the luggage as well as impact and compression from outside forces. Accordingly, Jones fails to teach novel aspects of the present invention.

U.S. Pat. No. 5,197,580 to Berman et al., which is hereby incorporated by reference in its entirety, discloses a collapsible article of luggage in which a plurality of reinforcing panels or inserts allow the luggage to assume either a rigid or collapsible form. Berman et al. fail to teach a rigid pocket or compartment that is capable of storing objects in relative isolation from other luggage contents. Accordingly, Berman fails to teach novel aspects of the present invention.

U.S. Pat. No. 6,446,688 to Sutton, hereby incorporated by reference in its entirety, discloses a carry bag with a pouch insert and magnetic fasteners so that purse or bag contents may be easily transferred to another bag. Sutton does not teach an insert or compartment suitable for protecting contents from forces that may be applied by additional bag or luggage contents or from the outside environment. Accordingly, Sutton fails to teach novel aspects of the present invention.

Backpacks often include a plurality of storage areas for the receipt of books, laptop computers, cell phones, and other important or valuable items. Most backpacks are made of a soft, compliant material, which makes the items stored therein susceptible to damage if the backpack is dropped or mishandled. Stated differently, the fabric outer material employed by most backpacks does little to protect the items stored therein from shock or impact damage. Thus, to ensure fragile items are protected, a secondary case for those items must be employed. For example, glasses are also stored in a specialized case that is placed in the backpack. Individuals, however, often do not employ this secondary layer protection or forget/misplace item-specific protective cases.

Thus it is a long felt need to provide a backpack or other storage device that includes a compartment that protects the items stored therein from damage (especially against impact or shock damage). One embodiment of the present invention provides a rigid storage case that is accessible by way of a door located on the outer surface of the backpack.

SUMMARY

The present invention relates generally to an apparatus that offers the flexibility and convenience of a conventional soft luggage piece with an additional rigid storage compartment. More specifically, the present invention relates to a soft luggage piece with a removable insert that may be optionally employed to protect contents such as glasses, goggles, electronics, and other valuable or delicate items.

It is one aspect of the present invention to provide a luggage unit with a selectively removable rigid compartment for protective storage and isolation of items. In one embodiment, the rigid compartment comprises a hard shell which may be disposed within a region of the luggage unit which further comprises a rigid cover or flap for containing the rigid compartment and/or items to be stored.

It is another aspect of the present invention to provide a luggage unit with a selectively removable compartment wherein the selectively removable compartment does not increase the total volume of the luggage unit or substantially reduce the usable interior volume of the luggage unit after the removable component is removed from a receiving portion.

It is yet another aspect of the present invention to provide a substantially soft luggage unit that may operate as a traditional soft luggage unit (e.g. backpack) when the selectively removable compartment is not employed.

It is yet another embodiment of the present invention to provide a device that allows a user to insert and remove a rigid compartment with relative ease and quickness while still providing secure attachment means so that the risks of loss or displacement of the rigid compartment are reduced.

In various embodiments, the present invention comprises an insertable rigid compartment which is dimensioned to be securely placed within a flexible compartment of a bag or luggage device, the compartment specifically adapted to receive the rigid compartment. For example, in one embodiment, a rigid insert or case is provided with a length, width and depth, wherein the depth of the insert is the only dimension capable of being inserted into an initial opening or perimeter edge of the compartment adapted to receive the insert. In other words, the depth of the insert is less than the width of the receiving portion. Thus, in one embodiment, the insert must be placed in the compartment by positioning the insert in a manner that is offset or obtuse from an intended final position and rotated into a secure position until it is to be selectively removed via similar procedures. While in place, the insert is impeded from inadvertent removal by the length or width of the insert being larger than the length or width of at least a perimeter edge of the receiving portion. Further, the flexible compartment or "receiving portion" in one embodiment is comprised of a stretchable material which biases the rigid insert upward against the edge of the perimeter opening to the receiving portion.

As used herein, "obtuse" refers to an orientation of a rigid insert, wherein a planar opening portion of the insert, and therefore the insert itself, is generally offset with respect to a plane of the receiving portion and/or perimeter edge. It will be recognized that the offset may be with respect to any of the three axes of the insert or combinations thereof.

In an alternative embodiment, the present invention comprises an insert adapted to be placed within a luggage compartment, wherein the insert comprises an at least partially deformable material. For example, in one embodiment, an insert is provided comprising an elastically deformable material, such as a rubber, which is adapted to elastically deform under specific user-applied forces yet generally provide protection for delicate items (e.g. glasses) when the insert is subject to various forces. The elastically deformable insert may be temporarily deformed by a user for the purposes of inserting the insert into a compartment, wherein the insert elastically restores to an original position adapted for storing and protecting items.

In various embodiments, the present invention comprises a luggage item with a selectively insertable and substantially rigid insert wherein the substantially rigid insert is at least partially affixed to the luggage item through one or more fastening devices. Fastening devices of the present invention include, but not are not limited to zippers, snaps, Velcro, buttons, magnets, cord locks, and similar devices. For example, in one embodiment, a substantially rigid insert is secured within a portion of a luggage item by zippering an edge portion of the insert to one or more zippers disposed on the luggage item.

In one embodiment, the present invention comprises a substantially rigid insert which is permanently interconnected to a portion of a luggage item. For example, in a particular embodiment, a luggage item is provided having a substantially rigid insert disposed therein, the interior and contents of the insert only being accessible from an exterior of the luggage item. The insert may be securely affixed to a portion of the luggage item, such as through stitching or sewing a portion of the insert to the luggage item. Access is provided by a hinged cover, preferably also constructed of a substantially rigid material and being selectively closable through the use of one or more zippers. In an alternative embodiment, a similar arrangement is provided wherein access to the interior and contents of the insert is achieved through an interior portion of the luggage item.

Substantially rigid inserts, hinged covers, etc. of the present invention are preferably constructed of one or more rigid materials including, but not limited to polypropylene, polyethylene, and various similar materials and polymers. In a preferred embodiment, at least an interior portion of an insert is provided with a shock absorbing material, such as EVA foam and optionally covered or coated with a non-abrasive textile.

In one embodiment, a luggage item comprises a compartment for receiving at least one substantially rigid insert, the compartment comprising a perimeter edge, lip or initial portion through which the insert is received and a portion of elastically deformable material generally disposed interior of the perimeter edge for receiving and stabilizing an insert. For example, in one embodiment, a luggage item is provided comprising a lip or initial portion defining an aperture and a stretchable product, such as lycra, extending inwardly from the initial portion. The stretchable or elastic product is designed to expand as necessary and receive a substantially rigid insert. Similarly, when the use and/or placement of an insert are not desired, the compartment comprising an elastically deformable material provides a non-rigid, flexible structure which collapses, and hence does not occupy a substantial internal volume of the luggage device.

In an alternate embodiment, a luggage item is provided having an aperture portion adapted for receiving a lip or perimeter edge of a removable insert, the outer portion of the removable insert being generally exposed to an internal volume and potential contents of the luggage item. Thus, in at least one embodiment, the present invention does not comprise a pouch or compartment for receiving an insert. Rather, the rigid structure of the insert and connection with a lip or initial portion of the luggage item defines a space within which items may be stored and/or secured.

In yet another embodiment, the present invention comprises a self-contained or "take-away" case which does not require combination with a luggage item for use. For example, a substantially rigid insert is provided with an attached lid or closable portion such that the insert may be positioned within a portion of a luggage item, or may function solely as a rigid case or compartment without combination with the luggage item.

In various embodiments of the present invention, a carrying bag for storing articles is provided, the carrying bag comprising a substantially rigid insert and a receiving portion for the substantially rigid insert. In one embodiment, the receiving portion is at least partially disposed within an internal volume of the carrying bag and is adapted for selectively receiving the substantially rigid insert. The receiving portion may comprise an elastic material, such as spandex, lycra, cotton, rubber, etc., extending into an inner volume of the carrying bag in at least one state. Optionally, a substantially rigid hinged cover for selectively sealing the receiving portion is provided, the hinged cover being attached to the carrying bag and adapted for closing or sealing a receiving portion, whether or not the rigid insert is disposed therein.

In one embodiment, the substantially rigid insert or case has a width greater than a defined width of a perimeter edge of the receiving portion, a defined length greater than a length of a perimeter edge of the receiving portion, and at least one dimension, e.g. a depth less than a defined width of the receiving portion. Thus, the substantially rigid insert may be secured within the receiving portion by inserting the rigid compartment at an angle obtuse to a planar portion of a receiving portion, and exerting a rotational and linear force on the rigid compartment.

In a particular embodiment, a receiving portion and insert contained therein is only accessible from the exterior of the carrying bag. In an alternative embodiment, the receiving portion and contents thereof are accessible through an interior portion of the carrying bag.

One of ordinary skill in the art will recognize various means and/or devices by which the rigid insert may be secured within the receiving portion, including, but not limited to zippers, Velcro, magnets, and a pliable lip.

It is contemplated that the receiving portion and/or insert comprise a relatively small usable volume as compared with the volume of the carrying bag. For example, in one embodiment, an insert and receiving portion is provided which is no greater than ¼ of the volume of the bag generally. Thus, in various embodiments, the insert and receiving portion are adapted for carrying small or delicate items such as glasses, goggles, electronics, etc.

In one embodiment, a substantially rigid insert of the present invention comprises a generally rectilinear device comprising at least five walls. As used herein, generally rectilinear refers to an object having generally distinct wall structures and a defined interior volume, but is not limited to a device with sidewalls or walls at right angles to one another. Indeed, it is contemplated that the insert may have round or curved walls and, in alternative embodiments, comprises a generally hemispherical shape. In one embodiment, the present invention comprises a generally rectilinear object having six walls, at least one of the walls being hingedly connected to a remainder of the insert and sealable or closeable through various devices, such as zippers, snaps, Velcro, etc.

As used herein, means for securing the substantially rigid insert within the receiving portion refers to any number of known securing devices including, but not limited to magnets, Velcro, zippers, snaps, cords, elastic cords, cord locks, flaps, etc.

In various embodiments, a carrying bag with a removable accessory case or rigid insert for storing fragile articles is provided, the carrying bag further comprising an enclosure defined by at least a bottom portion and opposing side walls. As used herein, a bottom portion of an enclosure refers to a portion disposed generally opposite an entrance or perimeter edge portion of the enclosure, regardless of how the enclosure is oriented with respect to the carrying bag. One of ordinary skill in the art will recognize that features of the present invention may be disposed in any number of orientations with respect to a carrying bag. Thus, the terms bottom or lower used herein refer to an inner portion of the enclosure disposed opposite a receiving portion, the bottom portion and the perimeter opening having generally parallel planes. As used herein, a perimeter opening refers to a generally planar portion or aperture that comprises an area through which an insert or accessory case may be placed through a sidewall portion of a bag and thus contained, disposed, and/or secured within a receiving portion.

In one embodiment, a collapsible, stretchable receiving portion is provided at least partially disposed within said enclosure of said carrying bag with a substantially rigid case being selectively removable from the carrying bag and defined by at least a plurality of sidewalls to provide a protective space which is adapted to store a fragile article. The stretchable receiving portion in one embodiment provides a biasing force which secures the removable accessory case against a lower surface of the perimeter edge of the receiving portion, and thus prevents inadvertent removal thereof. The substantially rigid case may comprise at least one dimension that is larger than a corresponding dimension of a perimeter opening of the receiving portion, thus providing for a secure mating or fit of the removable accessory case within the receiving portion and inside the perimeter opening.

In one embodiment, the substantially rigid case is secured within the receiving portion by inserting the rigid compartment at an angle obtuse with respect to a planar portion of said perimeter opening, and exerting a rotational and linear force on the rigid compartment to provide securement. A cover may further be provided for selectively closing the receiving portion.

In various embodiments, a carrying bag for storing articles in two distinct compartments is provided. The carrying bag comprises a first enclosure defined by at least a bottom portion and a plurality of side walls and a second enclosure defined by a flexible, collapsible receiving portion which is disposed within the confines of the first enclosure and having a perimeter opening with an edge having a defined width and length.

In one embodiment, a substantially rigid insert that is removable from the carrying bag is provided wherein the rigid insert has at least one of a width greater than said width of said edge of said perimeter opening of the receiving portion, and a length longer than the length of said edge of said perimeter opening of the receiving portion. The substantially rigid insert is positioned within the flexible receiving portion by positioning the rigid insert at an obtuse angle with respect to the plane of the perimeter opening, and the insert is retained within said collapsible retaining portion by engaging a lower surface of the perimeter opening.

Thus, in various embodiments, a substantially rigid insert is provided having at least one dimension that is larger than a corresponding dimension of a perimeter opening of a receiving portion in which the insert may be housed. Accordingly, predetermined orientation and/or rotation of the insert are required in order to place the insert within the receiving portion and remove the insert from the receiving portion, thereby providing for secure containment of the insert when disposed within the receiving portion.

One of ordinary skill in the art will recognize that features and devices of the present invention are not limited to any particular type, size, or style of luggage item. Inserts and receiving portions as described herein may be employed in various different luggage items including, but not limited to duffle bags, laptop bags, camera bags, hand bags, attaché bags, brief cases, satchels, messenger bags, backpacks, waist packs, tote bags, rolling bags, etc. It will further be recognized that substantially rigid inserts of the present invention are not limited to those designed to carry any particular item. Indeed, inserts of the present invention may be sized and/or adapted to carry any number of items which an individual may wish to isolate or protect.

In various embodiments, a luggage item is provided with a rigid container wherein the rigid container is integrally fixed (i.e. not selectively removable) from the luggage item. In a preferred embodiment, the rigid container is accessible only from an exterior of the bag, and through at least one door hingedly connected to the container. In such embodiment, the container and the interior volume of the container is not accessible from within a main storage compartment of the luggage item. In certain embodiments, the luggage item comprises an outer fabric and an internal liner portion, and wherein the rigid container is provided between the outer fabric and the internal liner portion such that the rigid container is not visible or accessible from an interior of a main storage area of the luggage item.

BRIEF DESCRIPTION OF THE DRAWINGS

The accompanying drawings, which are incorporated in and constitute a part of the specification, illustrate embodiments of the invention and together with the general description of the invention given above and the detailed description of the drawings given below, serve to explain the principles of these inventions.

DETAILED DESCRIPTION

Figure 1:
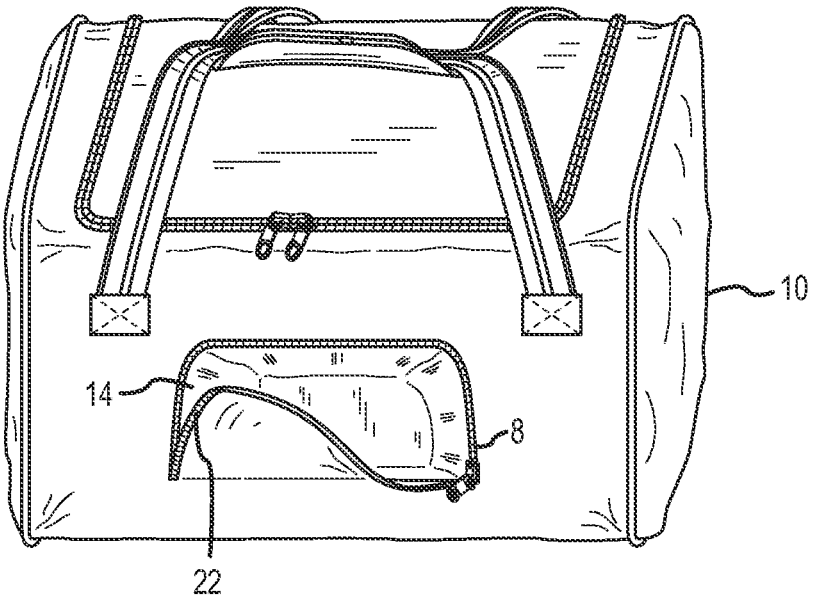
FIG. 1 is a front perspective view of a luggage unit with a substantially rigid removable compartment.
Figure 2:
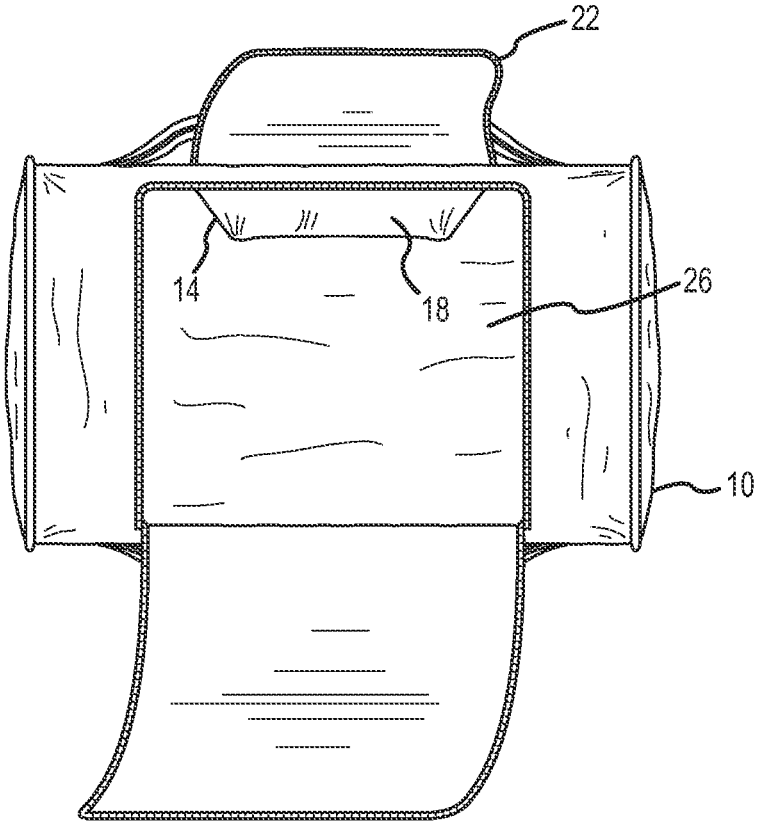
FIG. 2 is a top view of a luggage unit with a substantially rigid removable compartment.
Figure 3:
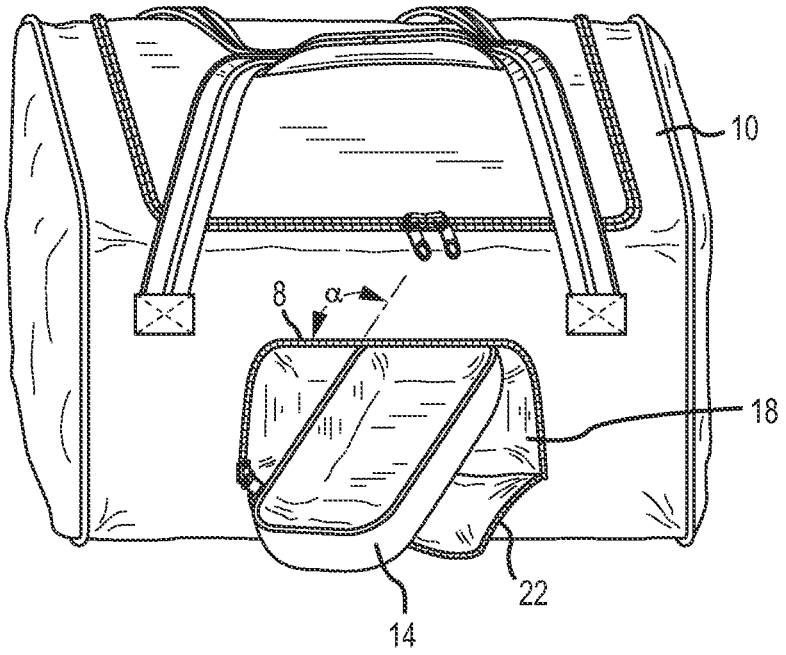
FIG. 3 is a perspective view of one embodiment of the present invention.

Referring now to FIGS. 1-3, a luggage unit 10 with a substantially rigid removable compartment or insert 14, a receiving area 18 for the substantially rigid insert, and a substantially rigid cover or closure means 22 is shown. The receiving portion 18 comprises a perimeter edge 8, the perimeter edge having a length and a width. As shown in FIG. 1, the length of the perimeter edge refers to a horizontal dimension and the width refers to a vertical dimension. However, one of ordinary skill in the art will recognize that the receiving area and corresponding perimeter edge may be oriented in any number of positions with respect to a luggage unit 10.

In one embodiment, luggage unit 10 is a generally soft or compressible bag, such as a "duffle" or "tote" bag with at least one compartment 26 for stowing items. One skilled in the art will appreciate that compartment 26 may house any number of items desired to be carried or transported by a user. It will further be appreciated that luggage units of this type may be made of any number of materials including, but not limited to nylon, canvas, cotton, leather, polyester or other similar materials and combinations thereof. Advantages of these devices, as will be recognized, include lightweight and compressibility or ease of storage when not in use. However, these devices suffer from disadvantages of having minimal impact resistance and objects disposed within these bags may be damaged upon dropping the bag or when other items impact or compress the bag.

Rigid insert 14 is provided as shown to allow for the protected storage of items within a generally soft bag. Rigid insert 14 may be disposed within a soft and flexible receiving portion 18. In one embodiment, the receiving portion 18 is comprised of a flexible material (e.g. spandex or other synthetic elastic material) capable of conforming to the dimensions of the rigid insert 14. Furthermore, receiving portion 18 is preferably constructed of a material with little structural integrity, thus preventing receiving portion 18 from maintaining a shape that may occupy a substantial portion of the interior volume of the compartment 26 when the rigid insert 14 is not used.

One skilled in the art will recognize that although receiving portion 18 is preferably intended to receive a rigid insert 14, it may also be used for stowage of items whether or not a rigid insert 14 is disposed within the receiving portion 18. Rigid insert 14 may be constructed of a lightweight material that resists deformation and fracture from externally applied forces. Those skilled in the art will recognize that various materials may be employed to achieve objectives of the present invention. By way of example only, polypropylene, high density polyethylene, ultra high molecular weight polyethylene, polyvinyl chloride (PVC), carbon fiber, steels, and rubbers are a few of the materials which may comprise the rigid compartment 14. Rigid insert 14 may be coated with a non-abrasive material, such as a textile or rubber, so as to further prevent damage to items stowed within.

The present invention further contemplates a receiving portion 18 that does not comprise a flexible pouch or interior portion. For example, a rigid insert 14 may be disposed within an aperture of the luggage unit 10 wherein the rigid insert 14 is held in place by a lip or edge portion of the aperture. When the rigid compartment is not disposed within the bag, a flap or cover 22 may be closed to seal the luggage unit 10. Furthermore, various alternative embodiments and equivalents are contemplated by the present invention, including providing a net or wireframe in place of receiving portion 18 and providing various fastening means such as Velcro®, a zipper, magnet(s), and/or snaps to affix the rigid compartment 14 to the luggage unit 10.

Referring now to FIG. 3, an embodiment of the present invention is shown wherein the geometries of a rigid insert 14 and corresponding receiving portion 18 are utilized to provide additional fixation of the rigid insert 14. As one object of the present invention is to securely stow and transport delicate or valuable items, it is desirable to provide means for ensuring that the rigid insert 14 will not be easily dislodged from the present invention 10. Accordingly, in one embodiment, rigid insert 14 is constructed with a width greater than a width of the perimeter edge or first portion of the receiving portion 18 and a depth less than a width of a first portion or perimeter edge of receiving portion 18. Accordingly, in order to insert rigid insert 14, it is necessary to first orient the rigid insert 14 in a first position wherein the depth of the rigid insert 14 is allowed to pass through the width of first portion of receiving portion 18. Once the rigid insert 14 has been substantially inserted into the receiving portion 18, it may then be turned and/or rotated to its ultimate desired orientation. It will be recognized that this process may simply be reversed in order to extract the rigid insert 14. It will further be recognized that this feature of the present invention may similarly be achieved by any number of variations to the geometries described herein. In one embodiment, the receiving portion 18 is comprised of a flexible material, such as the previously described spandex, to accommodate this insertion and extraction process. This process requires a sufficient level of user input to insert and extract the rigid insert 14 and thus reduces the risk of the rigid insert 14 becoming involuntarily dislodged.

In another embodiment, a rigid compartment 14 may be sized so that it requires insertion at an angle obtuse to a planar surface of an aperture of the receiving portion 18. The rigid compartment 14 may be sized so that it does not mate with the receiving portion 18 unless it is first directed toward the receiving portion at an obtuse angle and a user either rotates or applies torsion to the rigid compartment in order to insert the entirety of the compartment 14 into the receiving portion 18.

In another embodiment, the rigid insert 14 may be comprised of a substantially rigid material that is sufficient to prevent or mitigate the risk of damage to components housed within due to impact or compression forces, yet is still somewhat deformable under torsion. One of skill in the art will recognize various materials, including, but not limited to, rubbers and wireframe materials that may be suitable for this purpose. The use of these materials may allow for the construction of a rigid insert 14 that is larger than at least an entrance or aperture of the receiving portion 18. Such a rigid compartment may still be inserted into the receiving portion 18 by deforming the insert 14 under torsion, inserting the insert 14, and allowing it to reform to an original shape due to its own elastic forces.

In one embodiment, the rigid insert 14 may be comprised of two or more independent pieces which, when inserted sequentially, combine to form a single rigid insert 14 or housing. For example, one or more of a top, sides, and back portions of a insert 14 may be inserted into receiving compartments to ultimately form a single compartment within which items may be housed.

In another embodiment, a rigid insert 14 may be securely held within a soft luggage unit 10 by a rigid or semi rigid structure(s) surrounding an opening of the receiving portion 18. For example, an opening of a receiving portion 18 may comprise a pliable lip or perimeter edge 8 which requires at least some reformation by a user in order to insert a rigid insert 14. Once a rigid insert 14 is inserted into a receiving portion 18, the pliable lip or edge may provide sufficient restraint to prevent or reduce the risk of the rigid insert 14 becoming involuntarily dislodged. Additionally, a lip or perimeter edge 8 of a receiving portion 18 may comprise a buckle or fastener which allows for the lip or perimeter 8 edge to be expanded, the rigid insert 14 inserted, and the lip or perimeter 8 edge to be subsequently contracted and re-fastened so as to prevent or minimize the risk of loss of a rigid insert 14. One of skill in the art will recognize various fasteners that may be utilized in this embodiment, including, but not limited to, snaps, buckles, Velcro, elastic draw strings, laces, etc.

One of skill in the art will further recognize various different methods for securing the removable rigid insert 14. Rigid insert 14 may be secured within the bag 10 by a zipper or zippers, magnetic fastener(s), Velcro®, and various other means that allow for selective application and removal of the rigid compartment 14. For example, a zipper may be employed to secure at least part or a whole of the circumference of a rigid insert 14 to an aperture of the receiving portion 18. In one embodiment, the rigid compartment 14 may have Velcro portions which are received by corresponding Velcro portions within the receiving portion 18. In another embodiment, the compartment 14 may contain any number of magnetic portions, or be comprised of a magnetic material, which attached to corresponding magnetic portions of the receiving portion 18. One of skill in the art will recognize that these fastening means may be used either in addition to or in place of various other embodiments.

Although FIGS. 1-3 depict a single rigid insert 14 and a single receiving portion 18, it will be recognized that any number of additional rigid compartment and receiving portions of similar design and construction may be included in a soft luggage piece 10.

Figure 4:
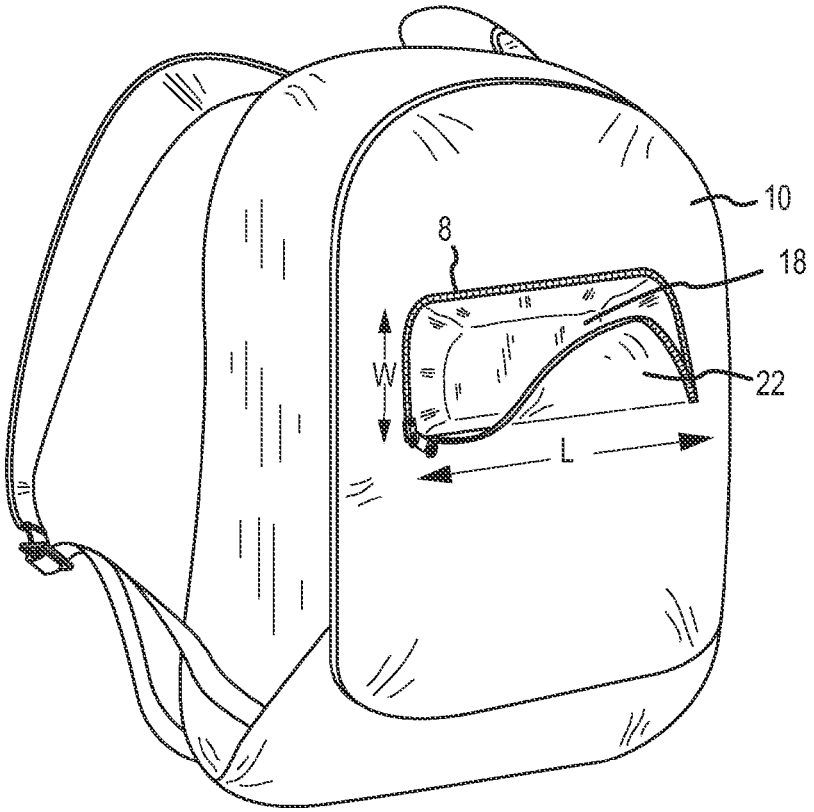
FIG. 4 is a perspective view of a luggage unit with a substantially rigid removable compartment according to another embodiment of the present invention.

Referring now to FIG. 4, alternative embodiments of the present invention are shown wherein a rigid insert 14 may be disposed within different luggage units. These additional luggage units may comprise backpacks, shoulder bags, or specialty bags such as ski and snowboard bags. As one of skill in the art will recognize, the precise location of the rigid insert 14 is not critical to the present invention. While it is sometimes desirable to provide a rigid insert 14 that is accessible from the exterior of the luggage unit 10, the disclosed device also contemplates the same or similar rigid portion 14 that is accessible from an interior portion or pocket of the luggage unit 10.

Figure 5:
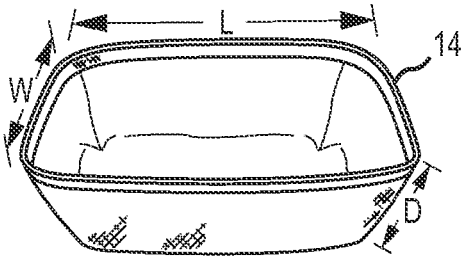
FIG. 5 is a perspective view of a substantially rigid removable compartment according to one embodiment of the present invention.

FIG. 5 depicts a detailed view of a substantially rigid insert 14 according to one embodiment of the present invention. The insert 14 comprises a length L, a width W, and a depth D. The insert is sized so as to fit within a receiving portion of one or more luggage items. However, as shown and described herein, at least one of the width and/or length of the insert 14 is sized such that it is larger than a corresponding width and/or length of a perimeter edge 8 of the receiving portion 18. Accordingly, specific manipulation is required to both insert and remove the insert from the receiving portion, providing for secure containment of the insert 14 and thereby reducing or minimizing risk of loss of the same.

Figure 6:
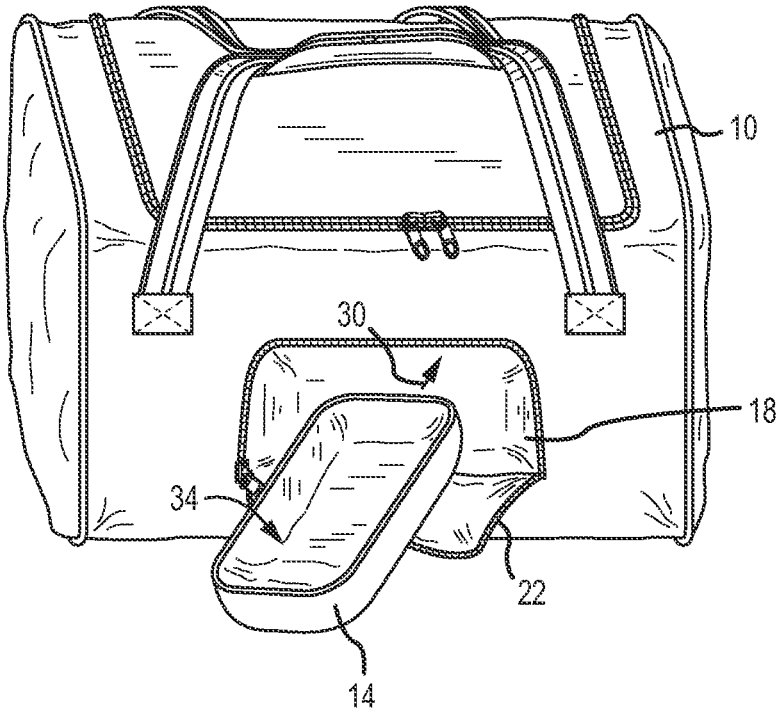
FIG. 6 is a front perspective view of a luggage unit according to one embodiment of the present invention.

Referring now to FIG. 6, an embodiment is depicted wherein a rigid insert 14 requires specific operation by a user in order to be disposed within a receiving portion 18. Rigid insert 14 is preferably inserted into receiving portion 18 by applying both a linear force 30 and a rotational force 34. As previously described, a rigid insert 14 may be dimensioned so that at least some dimensions of the rigid insert 14 are larger than corresponding dimensions of first portion or a perimeter edge 8 of receiving portion 18. Accordingly, rigid insert 14 must first be positioned so that, for example, its height is to pass through a width of receiving portion 18 in order to dispose the insert within the receiving portion Rigid insert 14 may also need to be positioned at an angle obtuse to a planar surface of receiving portion 18. In order to insert the rigid insert 14, rotational force 34 may be applied in addition to linear force 30. In one embodiment, once a rigid insert 14 is inserted and properly aligned, at least one of its dimensions will be greater than a corresponding dimension of a first part or perimeter edge of a receiving portion 18. In this manner, risk of the rigid compartment 14 becoming involuntarily dislodged and/or lost is reduced.

Figure 7:
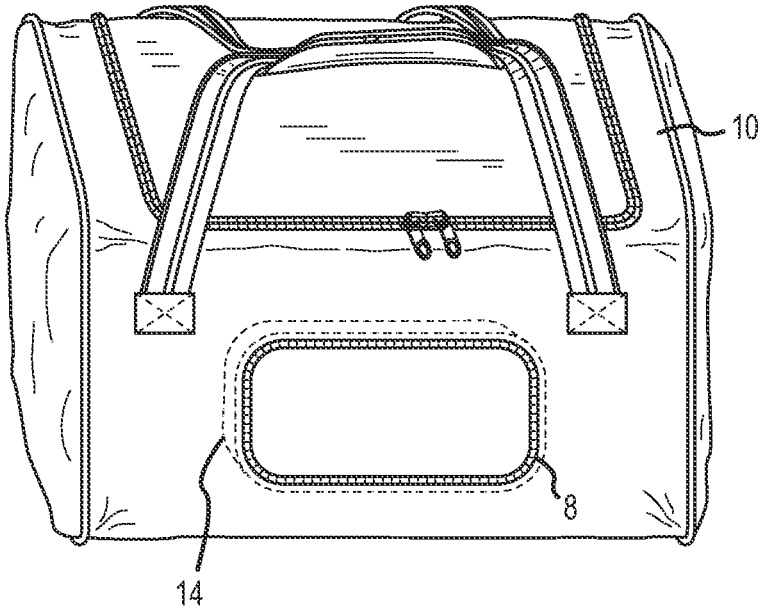
FIG. 7 is a front perspective view of a luggage unit according to one embodiment of the present invention.

Referring now to FIG. 7, a perspective view of one embodiment of the present invention is shown wherein a rigid compartment 14 is disposed within a receiving portion 18. As shown, the width and length of the insert 14 are greater than the width and length of the perimeter edge 8 of the receiving portion 18. The receiving portion 18 comprises a stretchable, collapsible material which acts to bias the insert 14 such that a top portion of the insert 14 is in communication with a bottom or interior portion of the perimeter edge 8. Thus, the insert 14 is secured within the receiving portion 18 until an appropriate combination of user applied forces and/or rotation is employed to intentionally remove the insert.

Figure 8:
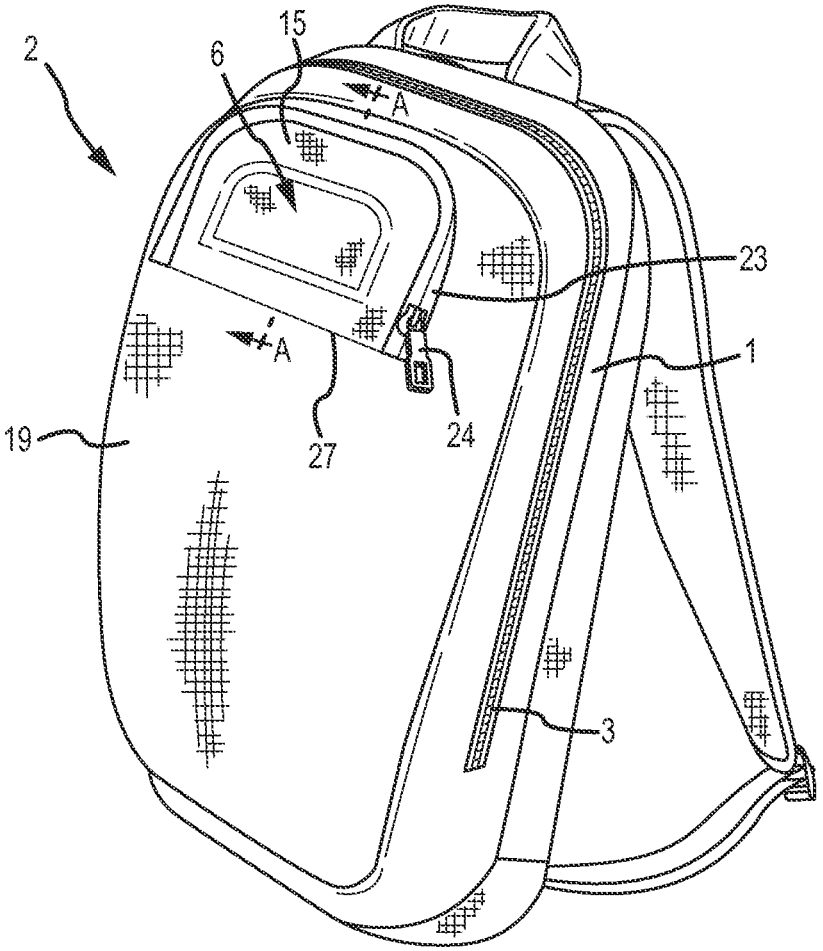
FIG. 8 is a perspective view showing a backpack with a rigid storage compartment according to one embodiment of the present invention.

FIG. 8 depicts an embodiment of the present invention wherein a backpack 2 is provided that includes a primary storage compartment 1 secured or closed by a zipper 3 and a secondary storage compartment 6 comprising a rigid interior container that is closed by a door 15. At least a portion of the door 15 is selectively interconnected to an outer fabric or surface 19 of the bag 2 by way of a zipper 23 or similar closure means. One of skill in the art will appreciate that other known closure mechanisms may be used to selectively interconnect the door 15 to the outer surface 19 of the bag 2 without departing from the scope of the invention.

The door 15 of one embodiment of the present invention is hingedly interconnected to the outer surface 19 of the bag 2. In various embodiments the door 15 comprises a rigid door member. Alternatively, the door member 15 may be a flexible or non-rigid member. In the embodiment shown in FIG. 8, a hinge 27 is provided for hingedly securing the door 15 to the bag 2. The hinge 27 comprises a flexible hinge that is devoid of the zipper 23 or similar closure means. Accordingly, in preferred embodiments, the zipper 23 extends around only a portion of a perimeter or circumference of the door 15.

Figure 9:
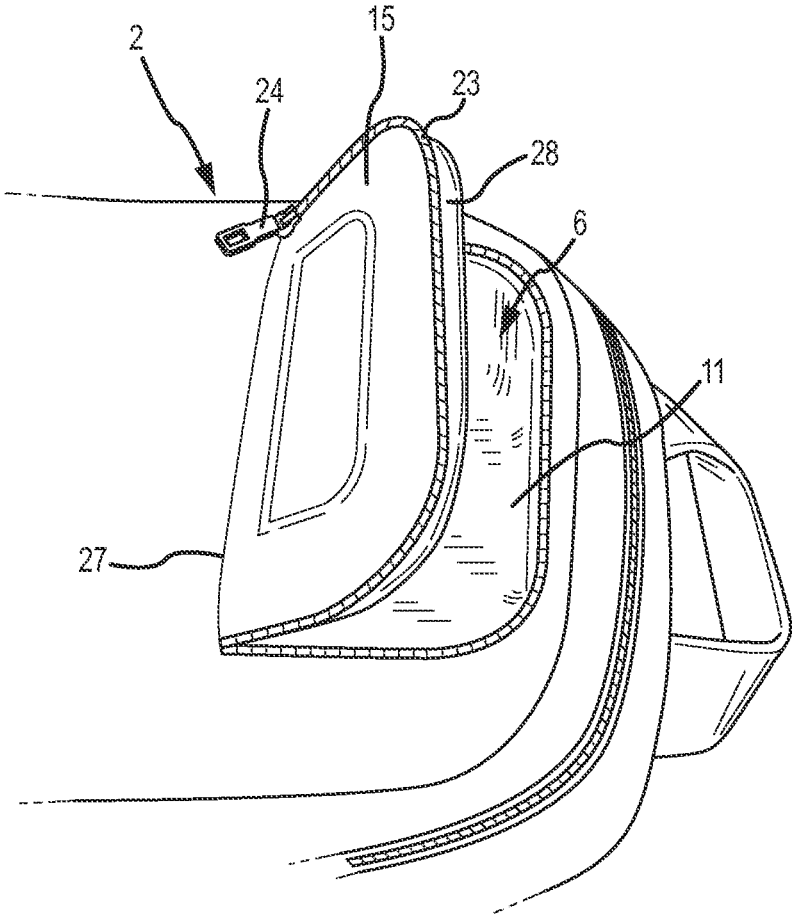
FIG. 9 is a perspective view showing the backpack of FIG. 8 and with a protective storage area in a partially open configuration.

FIG. 9 is a perspective view of the embodiment of FIG. 8 wherein the door 15 is provided in a partially open position, revealing an interior volume 11 of a secondary storage compartment 6. As shown, the door 15 comprises a flange 28 for extending at least partially into the interior volume 11. The flange 28 extends around at least a portion of the perimeter or circumference of the door. For example, and as shown in FIG. 9, the flange 28 extends around three sides of a rectilinear door wherein the edge or portion of the door 15 comprising the hinge 27 is devoid of the flange 28. A zipper pull 24 is provided for operating the zipper or closure means 23.

Figure 10:
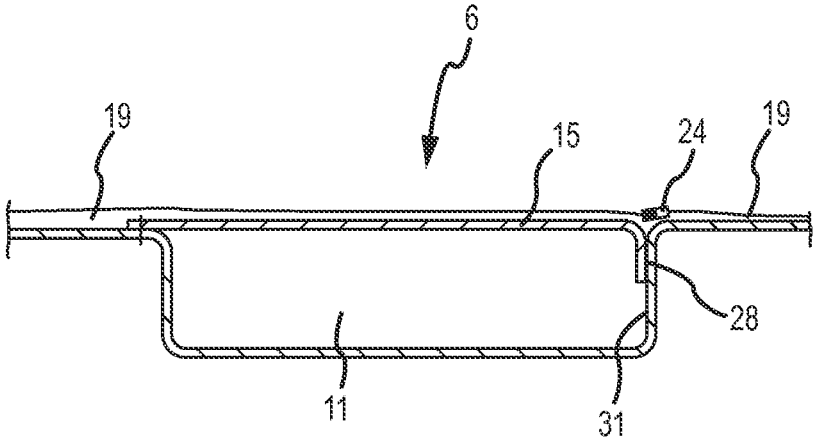
FIG. 10 is a partial cross-sectional elevation view of a storage compartment according to one embodiment of the present invention taken at line A-A of FIG. 8.

FIG. 10 is a cross-sectional elevation view of one embodiment of the present invention and taken about line A-A of FIG. 8. Referring now to FIG. 10, the door 15 comprises a flange 28 that engages an inner surface 31 of the compartment 6. When the door 15 is closed, the backpack fabric 19 extends over the door and is interconnected to a reminder of the fabric 19 of the bag 2 by way of a zipper 23, for example. The flange 28 extends substantially perpendicular to a planar portion of the door 15 and substantially parallel to at least one sidewall of the secondary storage compartment 6. Such a configuration gives the bag 2 a unified aesthetic appearance. Thus, embodiments of the present invention comprise a substantially flush outer surface, at least when the door 15 is closed and the zipper 23 secured or closed. Additionally, the closure features of the secondary storage compartment 6 as shown and described herein provide a frictional fit that prevents or reduces entrance of debris, dust, water, etc.

The flange 28 is contemplated as comprising any one of a number of materials. In certain embodiments, the flange 28 provides a frictional fit with a sidewall 31 that prevents unwanted entrance of materials including, but not limited to debris, dust, water and the like. In one embodiment, the flange comprises a material that is elastically deformable (e.g. rubber) that is adapted to seal against the sidewall 31. In various embodiments, sidewalls of the storage compartment 6 may similarly comprise elastically deformable materials to provide such a seal or fit.

In operation, to access the secondary storage compartment 6 the zipper is opened with a zipper pull 24, thereby allowing the door 15 to be rotated open. After items are placed within the secondary storage compartment 6, the door 15 may be closed and the zipper 23 reengaged. Thus a secure and impact-resistant storage area is provided which will protect fragile items.

Figure 11:
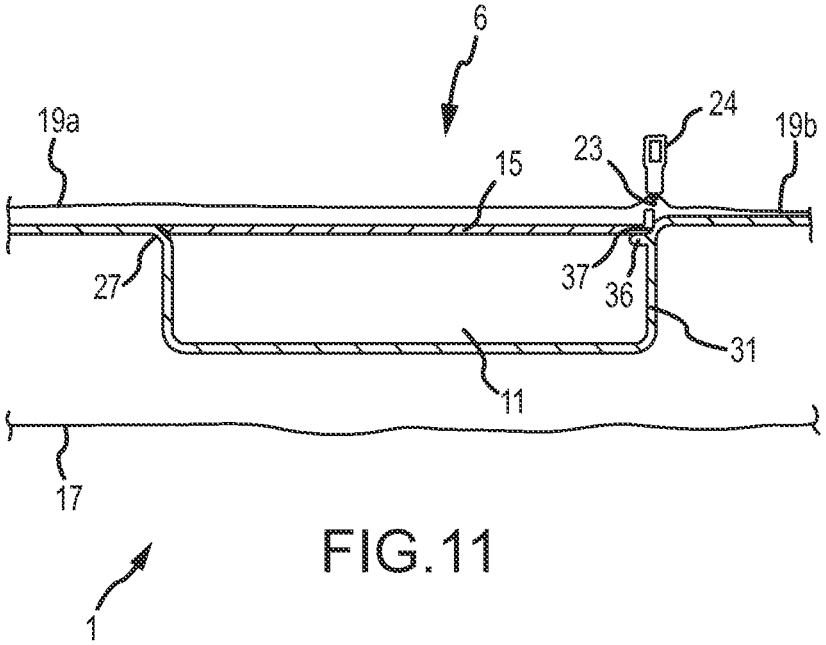
FIG. 11 is a cross-sectional perspective view of a storage compartment according to another embodiment of the present invention.

FIG. 11 is a cross-sectional perspective view of a carrying bag with a primary 1 and secondary storage compartment 6 according to one embodiment of the present invention. The primary storage area 1 and secondary storage area 6 are generally divided or separated by a panel member 17. The panel member 17 comprises a fabric or textile member, for example, that defines at least a portion of the volume of the primary storage area 1. The panel member 17 and relative positioning of the storage containers 1, 6 are not limited to the embodiment provided in FIG. 11. It is contemplated that the embodiment of FIG. 10, for example, similarly comprises such features. As shown, the secondary storage compartment 6 of FIG. 11 comprises a door 15 that is hingedly connected to the lower portion by a hinge 27. A free end 37 of the door is provided opposite the hinge portion 27. An interior of a sidewall portion 31 comprises a stop 36, the stop 36 comprising an inward projection for limiting the amount of rotation of the door 15 and preventing the door from rotating into the interior volume 11 of the secondary storage compartment 6. In various embodiments, the stop 36 is provided and positioned to allow the door 15 to be provided substantially flush with an outer surface of the bag 2. In the embodiment shown in FIG. 11, the stop 36 limits rotation and/or closure of the door 15, such that when the door 15 is closed the outer fabric portions 19*a*, 19*b* of the bag are aligned and/or substantially coplanar with one another to facilitate closure of the zipper 23 and generally enhance the ease of use of the bag.

Figure 12:
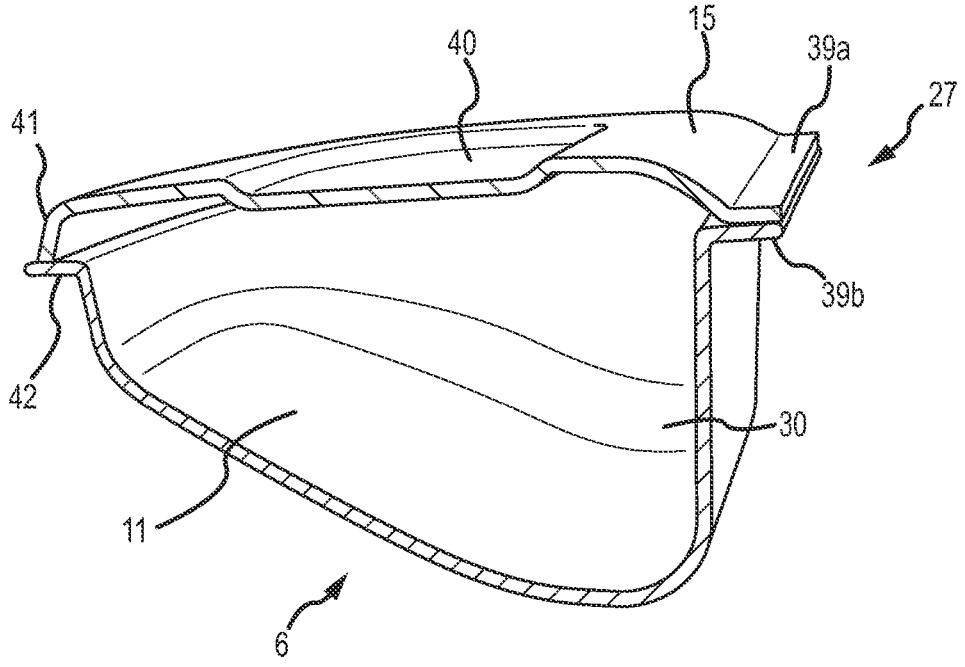
FIG. 12 is a cross-sectional elevation view of a storage compartment according to one embodiment of the present invention.

FIG. 12 is a cross-sectional perspective view of one embodiment of the present invention comprising a hinge member 27, the hinge member 27 comprising two flange members 39*a*, 39*b* on one side of the secondary storage compartment 6. Mating flanges 39*a*, 39*b* are provided such that at least a portion of the hinge is flexible and allows the container 6 and door 15 to be opened from a location substantially opposite the hinge member 27. The hinge flanges 39*a*, 39*b* may be placed in contact with one another and secured by various means, including welds, stitching, etc.

The door member 15 of FIG. 12 opens at a position opposite the hinge member 27. The compartment 6 comprises a peripheral edge 42. The peripheral edge generally comprises a shelf portion extending around the container 6, with the exception of the hinge 27. In certain embodiments where the compartment 6 comprises a generally rectilinear shape, the peripheral edge 42 extends around three of the four sides of the rectilinear shape. In the embodiment of FIG. 12, the door 15 comprises a flange or lip 41 for contacting the peripheral edge 42. The lip 41 preferably extends at an angle from a planar or main portion of the door 15. Such angle is preferably at least approximately 50 degrees. In certain embodiments, the lip 41 extends from a remainder of the door 15 and is substantially perpendicular to the door 15. In a preferred embodiment, the lip 41 and peripheral edge 42 comprise members that are substantially perpendicular to one another. In one embodiment, an angle provided at an interior corner of the flange and between the planar portion of the door 15 and the lip 41 is approximately 96 degrees. In another embodiment, an angle provided at an interior corner of the flange and between the planar portion of the door 15 and the lip 41 is approximately 120 degrees.

The relative positioning of the lip 41 and the peripheral edge 42 prevents over-rotation of the door 15 about the hinge 27. That is, the door 15 is allowed to hinge open at the hinge member 27, but is prevented from rotating into an interior volume 11 of the compartment 6 due to contact between the lip 41 and the peripheral edge 42.

The secondary storage compartment 6 may be of any shape. For example, the compartment 6 may accommodate most eyeglasses. Other embodiments include a compartment that is customized to receive and protect specific eyewear or specific electronic devices. The zipper 23 may be water-tight such that water ingress into the container is prevented. In one embodiment of the present invention, the compartment 6 and the door 15 are made of a rigid plastic material that is shock and impact resistant. One of skill in the art will appreciate that as long as the storage area is of a stiffer material than the backpack fabric, additional protection will be afforded the items stored within a compartment 6. The compartment 6 may also have an opening that accommodates a headphone wire that interconnects to a cell phone or other music playing device. The compartment 6 may be made of an insulative material where stored items will maintain the desired temperature.

Figure 13:
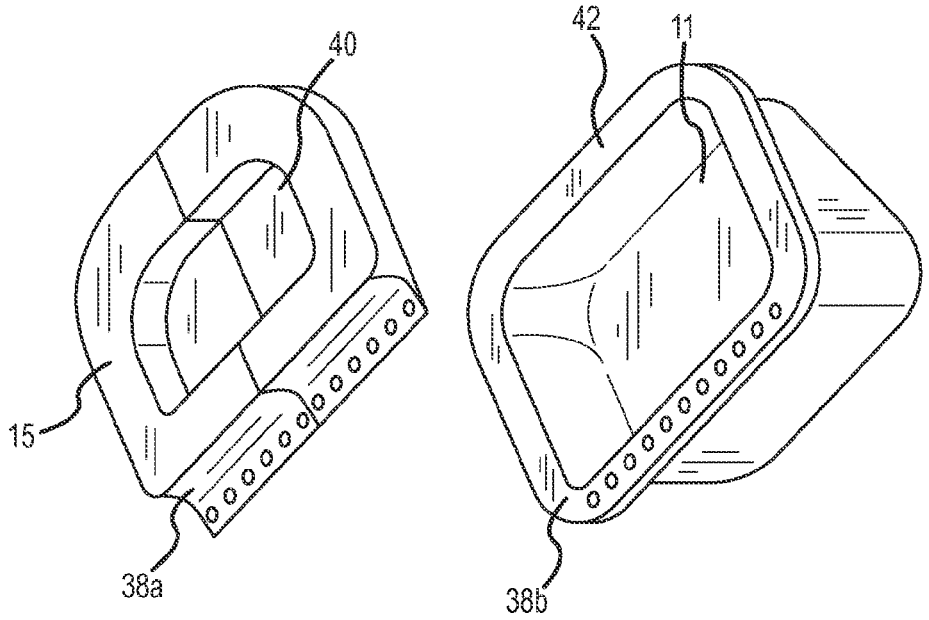
FIG. 13 is a perspective view of a storage compartment according to one embodiment of the present invention.

FIG. 13 is a perspective view of a storage compartment according to one embodiment of the present invention. As shown, a secondary storage compartment 6 comprises a volume 11 which is selectively covered or sealed by door 15. In certain embodiments, the door 15 comprises a depression 40 to provide structural rigidity to the door and reduce deflection or deformation of the door 15. The door 15 is provided in association with the secondary storage compartment 6 and is hingedly connected to the container via a hinge 38. The hinge 38 may comprise any number of features, fasteners, or securement members to allow to the door 15 to rotate or hinge relative to the secondary storage compartment 6. The present invention is not limited to any particular hinge or linkage device. In certain embodiments, the door 15 and secondary storage compartment 6 are stitched together, either directly or indirectly (e.g. with the inclusion of additional fabric material). The secondary storage compartment 6 comprises a peripheral edge 42 that generally comprises a flat shelf portion. The peripheral edge 42 receives an edge of the door 15 to secure or close the secondary storage compartment 6. The peripheral edge 42 extends around the secondary storage compartment 6. The door 15 is mated with the secondary storage compartment 6 at the hinge 38 by two substantially parallel or flush portions 38*a*, 38*b*.

Substantially rigid inserts, hinged covers, etc. of the present invention are preferably constructed of one or more rigid materials including, but not limited to polypropylene, polyethylene, and various similar materials and polymers. In a preferred embodiment, at least an interior portion of an insert is provided with a shock absorbing material, such as EVA foam and optionally covered or coated with a non-abrasive textile.

What is claimed is:

1. A carrying bag comprising:

a primary storage compartment for storing articles;

a secondary storage compartment comprising a separate compartment from said primary storage compartment and wherein said secondary storage compartment is defined by a plurality of sidewalls to provide a protective space for storing articles;

a door for selectively closing the secondary storage compartment, wherein the door is attached to the carrying bag at a flexible hinge and wherein the flexible hinge is devoid of a zipper or other closure device;

the door comprising a lip positioned on a distal end opposite from the flexible hinge, the lip extending at an angle to a planar portion of the door and extending over at least one of the plurality of sidewalls of the secondary storage compartment, and wherein the planar portion of the door extends substantially parallel to an exterior of the carrying bag when the door is provided in a closed position.

2. The carrying bag of claim 1, wherein the door comprises a substantially rigid door.

3. The carrying bag of claim 1, wherein an interior of the secondary storage compartment comprises a non-abrasive material.

4. The carrying bag of claim 1, wherein the secondary storage compartment is only accessible from an exterior of the carrying bag.

5. The carrying bag of claim 1, wherein said secondary storage compartment comprises a generally rectilinear shape having at least five walls which define a void space adapted for storing fragile items.

6. A carrying bag with multiple independent storage regions, comprising:

a primary storage compartment for storing articles;

a secondary storage compartment comprising a separate compartment from said primary storage compartment and wherein said secondary storage compartment is defined by a plurality of substantially rigid sidewalls to provide a protective space for storing articles;

a substantially rigid door for selectively closing the secondary storage compartment, wherein the substantially rigid door comprising a first end and a second end and a planar portion therebetween, the first end attached to the carrying bag at a hinge;

the second end of the substantially rigid door comprising a flange, the flange extending at an angle to a planar portion of the door and extending beyond at least one of the plurality of substantially rigid sidewalls of the secondary storage compartment and wherein the flange extends at least partially into the carrying bag and does not extend into the secondary storage compartment;

wherein the substantially rigid door is substantially flush with an exterior of the carrying bag when the door is provided in a closed position; and wherein the secondary storage compartment is accessible from an exterior of the carrying bag and wherein a zipper member is provided to selectively close the secondary storage compartment.

7. The carrying bag of claim 6, wherein the primary storage compartment is accessible when the substantially rigid door is closed.

8. The carrying bag of claim 6, wherein an interior of the secondary storage compartment comprises a non-abrasive material.

9. The carrying bag of claim 6, wherein the secondary storage compartment is only accessible from an exterior of the carrying bag.

10. The carrying bag of claim 6, wherein said secondary storage compartment comprises a generally rectilinear shape having at least five walls which define a void space adapted for storing fragile items.

11. A carrying bag with at least two independent storage compartments which are accessible from the exterior of the carrying bag, comprising:

a primary storage compartment for storing articles;

a secondary storage compartment comprising a separate compartment from said primary storage compartment and wherein said secondary storage compartment is defined by a plurality of substantially rigid sidewalls to provide a protective space for storing articles and which is accessible from an exterior portion of the carrying bag;

a substantially rigid door for selectively closing the secondary storage compartment, wherein the substantially rigid door is attached to the carrying bag at a hinge and wherein the door comprises a depression in a central portion of the door to provide structural rigidity and reduce at least one of deflection and deformation of the door;

the substantially rigid door comprising a flange opposite the hinge, the flange extending at an angle to a planar portion of the door and oriented substantially parallel to at least one side wall of the secondary storage compartment when the substantially rigid door is in a closed position;

wherein the flange extends at least partially along an exterior of the secondary storage compartment when the door is provided in a closed position; and wherein the carrying bag comprises an outer fabric layer, the outer fabric layer extending along said hinge of said substantially rigid door and wherein after closure of said substantially rigid door a substantially flush outer surface of the carrying bag is provided with respect to the substantially rigid door.

12. The carrying bag of claim 11, wherein the substantially rigid door is selectively closed by a zipper.

13. The carrying bag of claim 11, wherein an interior of the secondary storage compartment comprises a non-abrasive material.

14. The carrying bag of claim 11, wherein the secondary storage compartment is only accessible from an exterior of the carrying bag.

15. The carrying bag of claim 11, wherein said secondary storage compartment comprises a generally rectilinear shape having at least five walls which define a void space adapted for storing fragile items.

16. The carrying bag of claim 6, wherein the hinge is devoid of a zipper or other closure device.

17. The carrying bag of claim 11, wherein the flange extends at least partially along an exterior of a plurality of sidewalls of the secondary storage compartment to prevent over rotation of the door.

* * * * *